US007990330B2

(12) United States Patent
Wu

(10) Patent No.: US 7,990,330 B2
(45) Date of Patent: Aug. 2, 2011

(54) SLOT ANTENNA

(75) Inventor: Sueng-Chien Wu, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 386 days.

(21) Appl. No.: 12/233,598

(22) Filed: Sep. 19, 2008

(65) Prior Publication Data

US 2009/0303146 A1 Dec. 10, 2009

(30) Foreign Application Priority Data

Jun. 10, 2008 (CN) ..... 2008 2 0301090 U

(51) Int. Cl.
*H01Q 13/10* (2006.01)

(52) U.S. Cl. ..... 343/770; 343/767; 343/846

(58) Field of Classification Search ..... 343/770, 343/795, 702, 846, 786, 715, 705
See application file for complete search history.

(56) References Cited

U.S. PATENT DOCUMENTS

| | | | | |
|---|---|---|---|---|
| 5,917,454 | A * | 6/1999 | Hill et al. | 343/769 |
| 2005/0116868 | A1 * | 6/2005 | Shikata et al. | 343/745 |
| 2005/0116875 | A1 * | 6/2005 | Yuanzhu et al. | 343/846 |
| 2007/0241983 | A1 * | 10/2007 | Cao et al. | 343/797 |
| 2009/0237314 | A1 * | 9/2009 | Lalezari | 343/721 |

FOREIGN PATENT DOCUMENTS

CN 1528090 A 9/2004

* cited by examiner

*Primary Examiner* — Douglas W Owens
*Assistant Examiner* — Jae K Kim
(74) *Attorney, Agent, or Firm* — Frank R. Niranjan

(57) ABSTRACT

A slot antenna is located on a substrate and includes a grounding portion, a radiating portion, and a feeding portion. The grounding portion is positioned on the substrate. The radiating portion is symmetrically octagonal-shaped and defines four trapezoidal-shaped slots on opposite sides. The radiating portion is parallel to the grounding portion. The feeding portion electrically connects the radiating portion to the grounding portion for feeding electromagnetic signals to the slot antenna.

10 Claims, 6 Drawing Sheets

SLOT ANTENNA

BACKGROUND

1. Field of the Invention

Embodiments of the present disclosure relate to antennas, and particularly, to a slot antenna.

2. Description of Related Art

Due to an increasing demand for wireless communication devices, there has been significant growth in wireless communication technology. Antennas are essential components in wireless communication devices for radiating electromagnetic signals. Frequency band and stability of antennas are especially significant factors to consider in the design of antennas.

Wideband slot antennas are very widespread in terms of research and practical application of antennas. Due to temperature variation, frequency offsets of slot antennas often occur. The slot antennas associated therewith are consequently required to have a wide and stable frequency band that is not affected by the temperature.

SUMMARY

An exemplary embodiment of the present disclosure provides a slot antenna. The slot antenna is located on a substrate and comprises a grounding portion, a radiating portion, and a feeding portion. The grounding portion is placed on the substrate. The radiating portion is symmetrically octagonal-shaped and defines four trapezoidal-shaped slots on opposite sides thereof. The radiating portion is parallel to the grounding portion. The feeding portion electrically connects the radiating portion to the grounding portion for feeding electromagnetic signals.

Other advantages and novel features of the present invention will become more apparent from the following detailed description of preferred embodiments when taken in conjunction with the accompanying drawings, in which:

DETAILED DESCRIPTION

Figure 1:
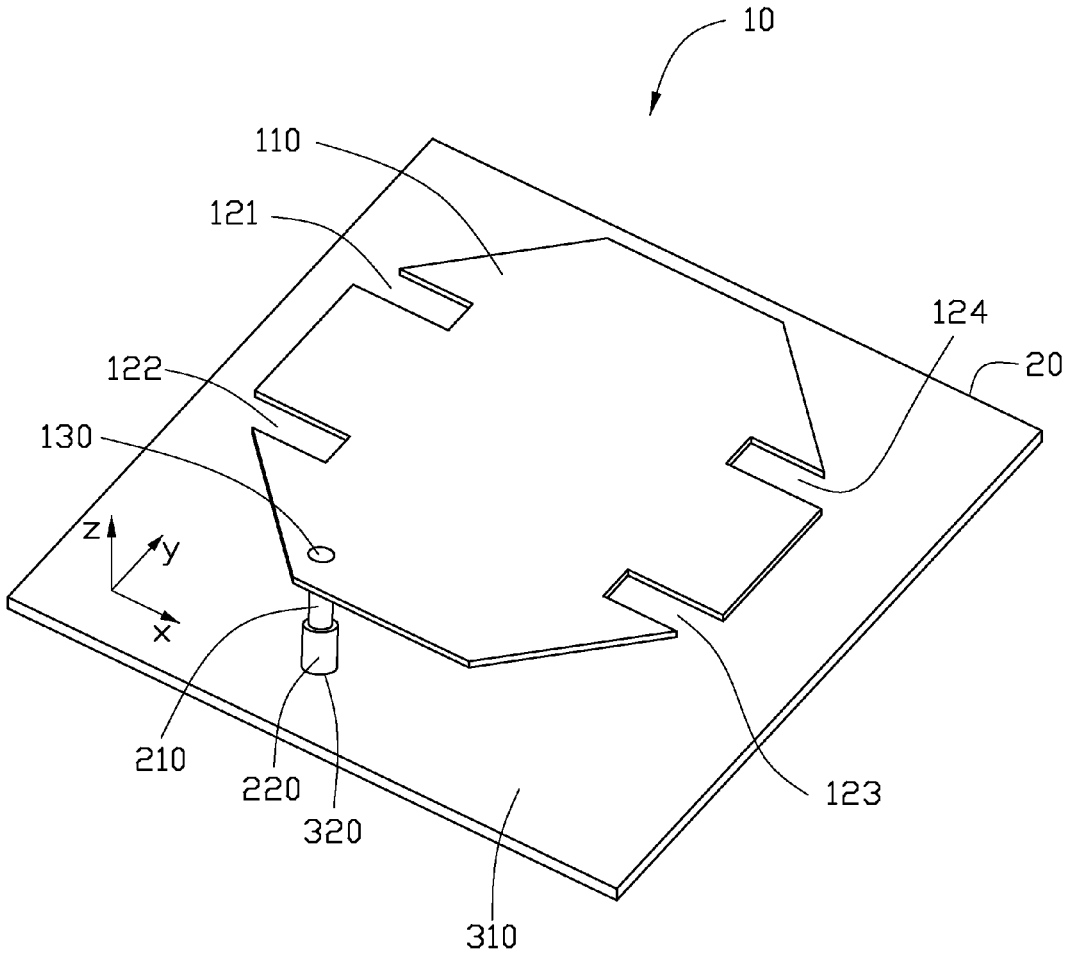
FIG. 1 is a schematic diagram of a slot antenna in accordance with an exemplary embodiment of the present disclosure.
Figure 2:
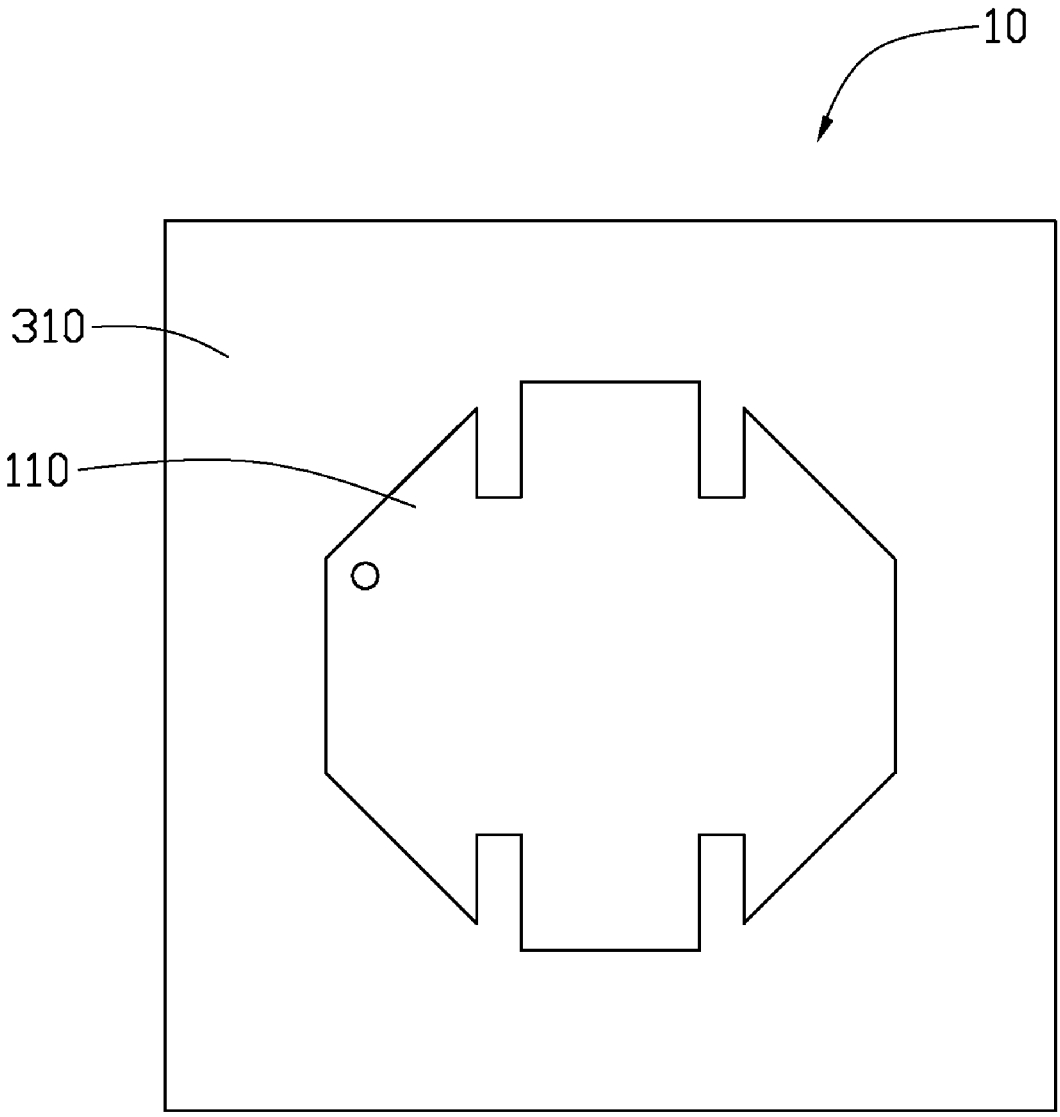
FIG. 2 is a top view of one embodiment of the slot antenna of FIG. 1.

FIG. 1 is a schematic diagram of a slot antenna 10 in accordance with an exemplary embodiment of the present disclosure. As shown, the slot antenna 10 is positioned on a substrate 20 and includes a radiating portion 110, a feeding portion 210, and a grounding portion 310. The grounding portion 310 is positioned on the substrate 20.

The radiating portion 110 is symmetrically octagonally-shaped and defines four slots at four corners of two opposite sides of the substrate 20. The radiating portion 110 transmits and receives electromagnetic signals for the slot antenna 10. The four slots are elongated along an X-axis and parallel with one another. The four slots include a first slot 121, a second slot 122, a third slot 123, and a fourth slot 124. Each slot 121, 122, 123, 124 is located at one of the four corners of the symmetrically octagonal-shaped radiating portion 110. In the present embodiment, the slots are shaped as right-angled trapezoids. The radiating portion 110 is parallel to the grounding portion 310.

The symmetrically octagonal-shaped radiating portion 110 improves the radiation performance of the antenna 10 via coordination with reducing the width of four right-angled trapezoidal slots.

The radiating portion 110 conjoins the feeding portion 210 at a feeding joint 130, wherein the feeding joint 130 is on one corner of the octagon without the slot 121, 122, 123, 124. The radiating portion 110, in one embodiment, is substantially parallel along the Y-axis to the grounding portion 310 so as to form a gap between the radiating portion 110 and the grounding portion 310.

The feeding portion 210 electrically connects the radiating portion 110 to the grounding portion 310. In one embodiment, the feeding portion 210 is cylindrically-shaped along a Y-axis and electrically connected to the feeding joint 130 through a welding process.

The grounding portion 310 defines a conductive via 320. In one embodiment, the projection of the feeding portion 210 onto the grounding portion 310 is received in the conductive via 320.

The slot antenna 10 further includes a connecting portion 220 that connects the feeding portion 210 to the grounding portion 310 through the conductive via 320. In one embodiment, the connecting portion 220 is cylindrically-shaped. The connecting portion 220 and the feeding portion 210 are tightly coupled together and can easily be connected and disconnected. For example, the connecting portion 220 may be frictionally coupled to the feeding portion 220.

In one embodiment, the grounding portion 310 and the radiating portion 110 are made of the same material. Preferably, the grounding portion 310 and the radiating portion 110 are made of iron for reducing costs. They can also be made of other metals, such as aluminum.

In one embodiment, the gap between the grounding portion 310 and the radiating portion 110 may be filled with air. Accordingly, the, the slot antenna 10 has a stable frequency that is substantially not affected by the temperature of an outside environment.

Figure 3:
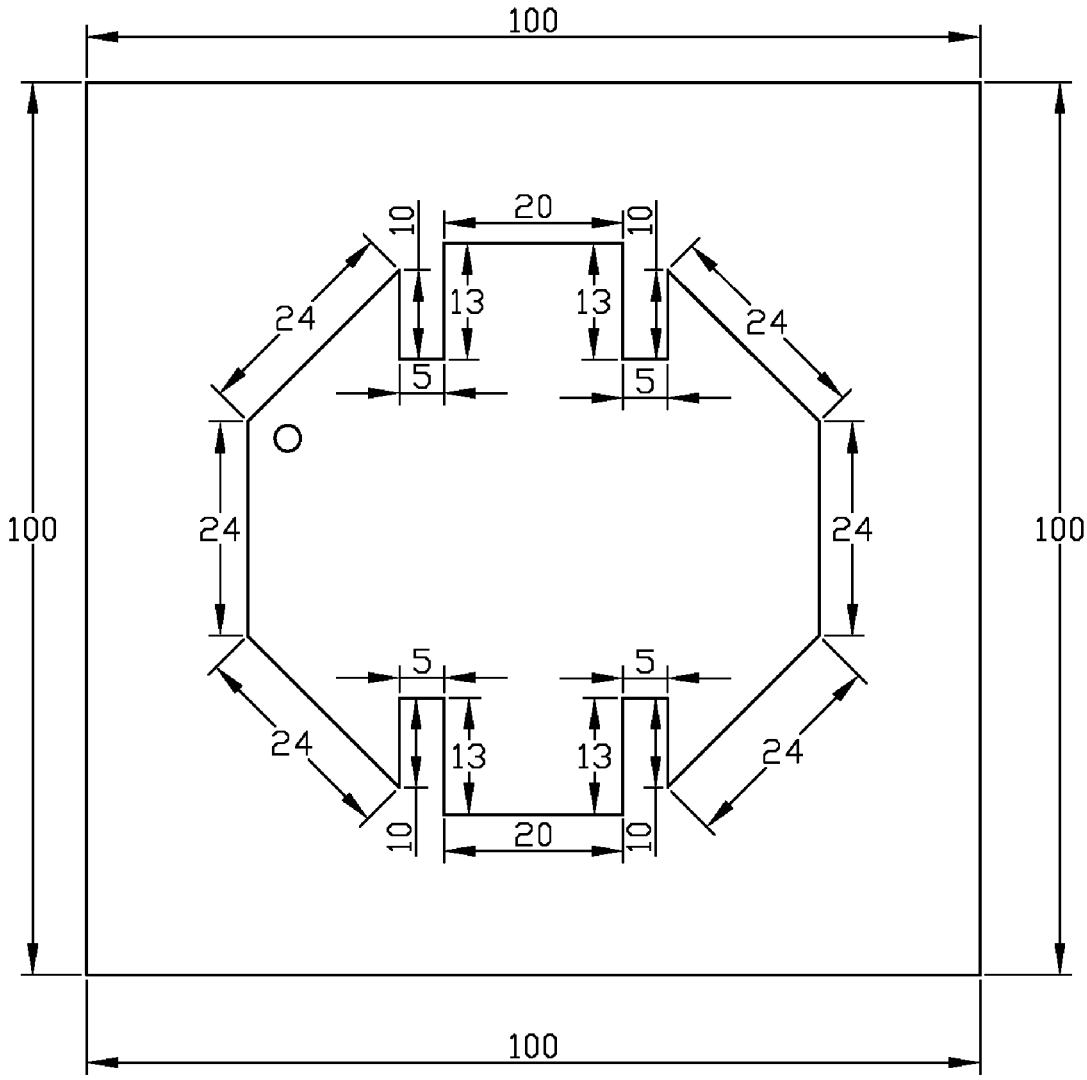
FIG. 3 shows one exemplary embodiment of dimensions of the slot antenna of FIG. 1.

FIG. 3 shows one exemplary embodiment of dimensions of the slot antenna 10 of FIG. 1. In one embodiment, the grounding portion 310 is square-shaped and has a length of approximately 100 millimeters (mm). Lengths of eight sides of the radiating portion 110 are respectively 24 mm, 20 mm, 24 mm, 24 mm, 24 mm, 20 mm, 24 mm, and 24 mm, starting from the top end as depicted in FIG. 3 in a counter-clockwise direction. The first slot 121, the second slot 122, the third slot 123, and the forth slot 124 are right-angled trapezoids in the same specification with a short side being approximately 10 mm, the long side being approximately 13 mm, and the height being approximately 5 mm.

Figure 4:
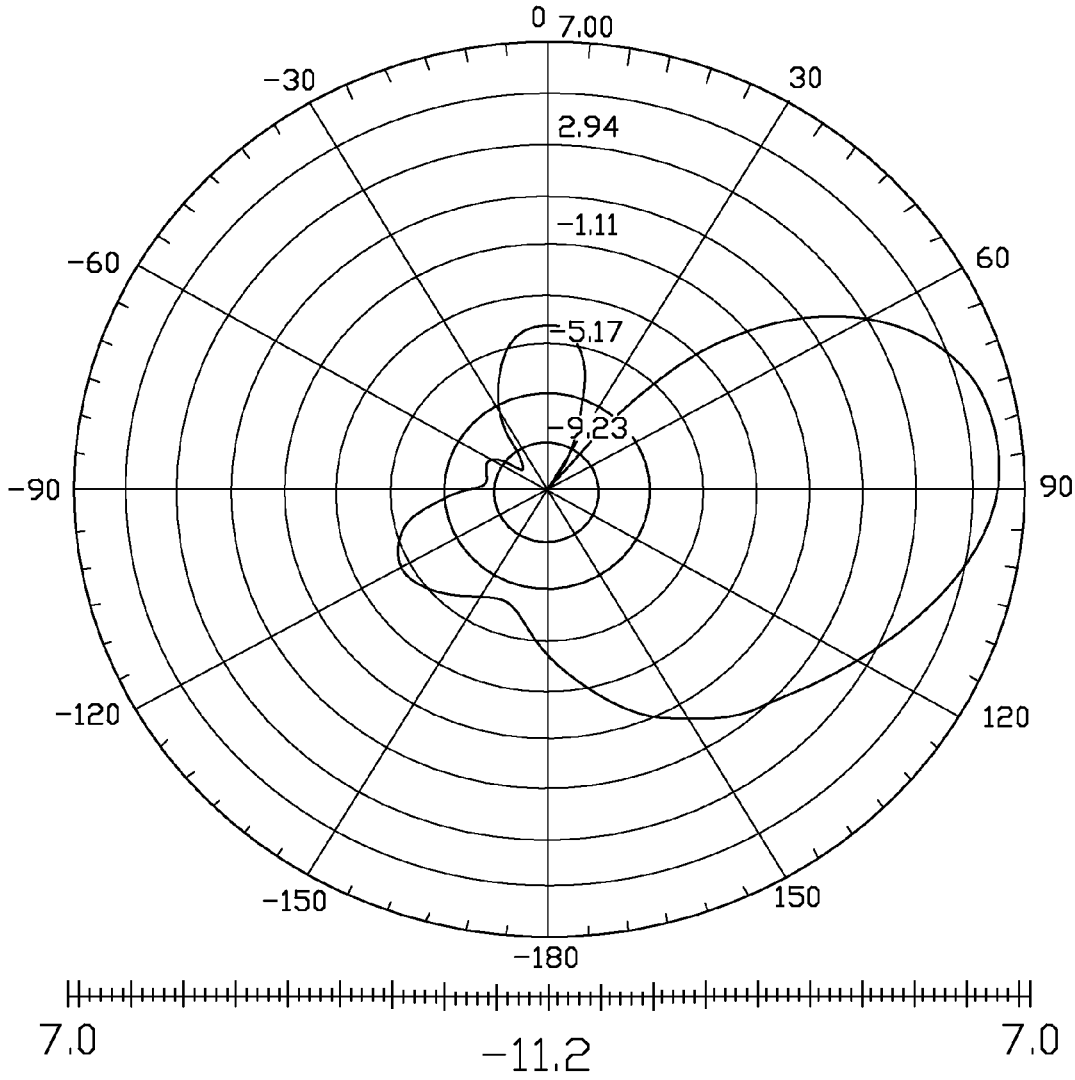
FIGS. 4-5 are test charts showing exemplary radiation patterns of one embodiment of the slot antenna of FIG. 1 with 45° and 60° angles, respectively.
Figure 5:
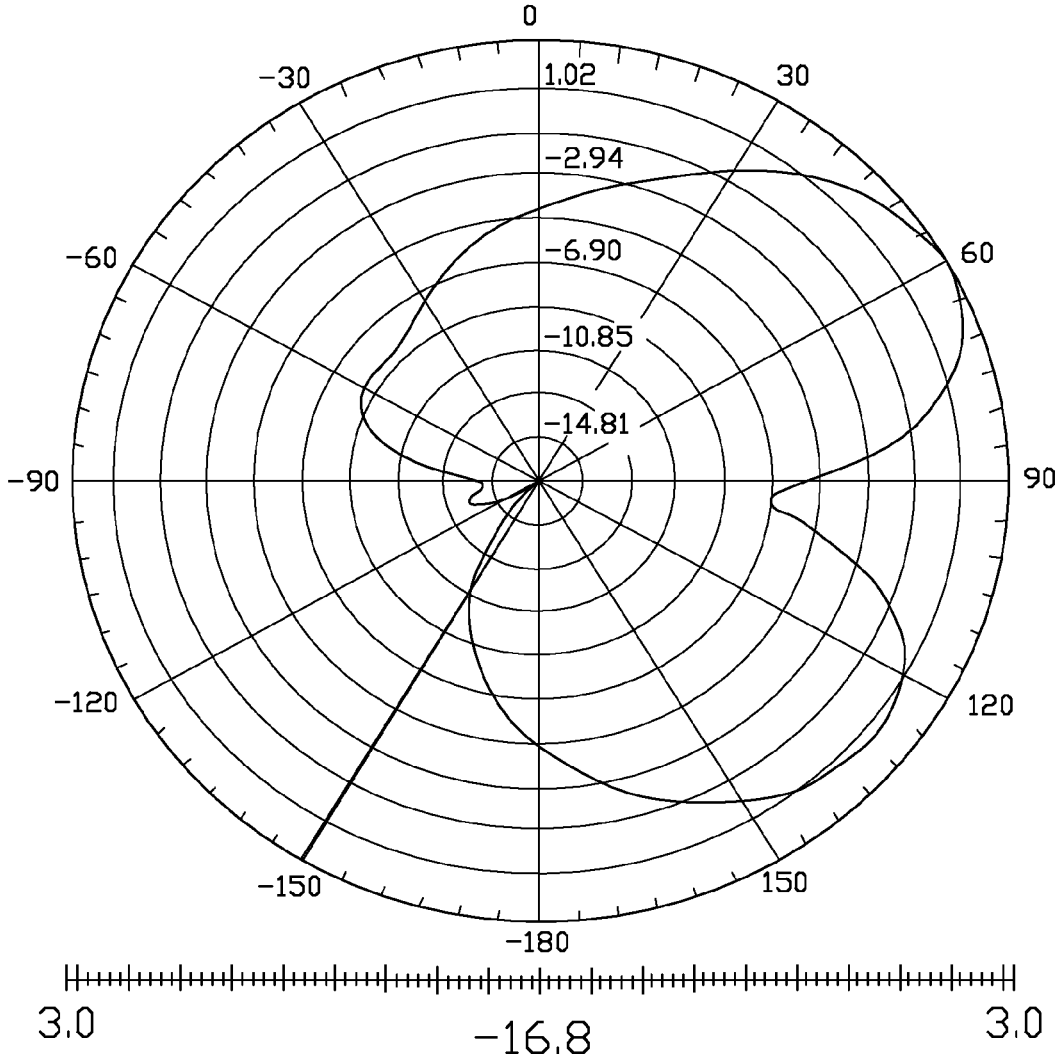

FIGS. 4-5 are test charts showing exemplary radiation patterns of one embodiment of the slot antenna 10 of FIG. 1 with 45° and 60° angles view, respectively. As shown, the slot antenna 10 can radiate at any angle and is quantified in accordance with application requirements.

Figure 6:
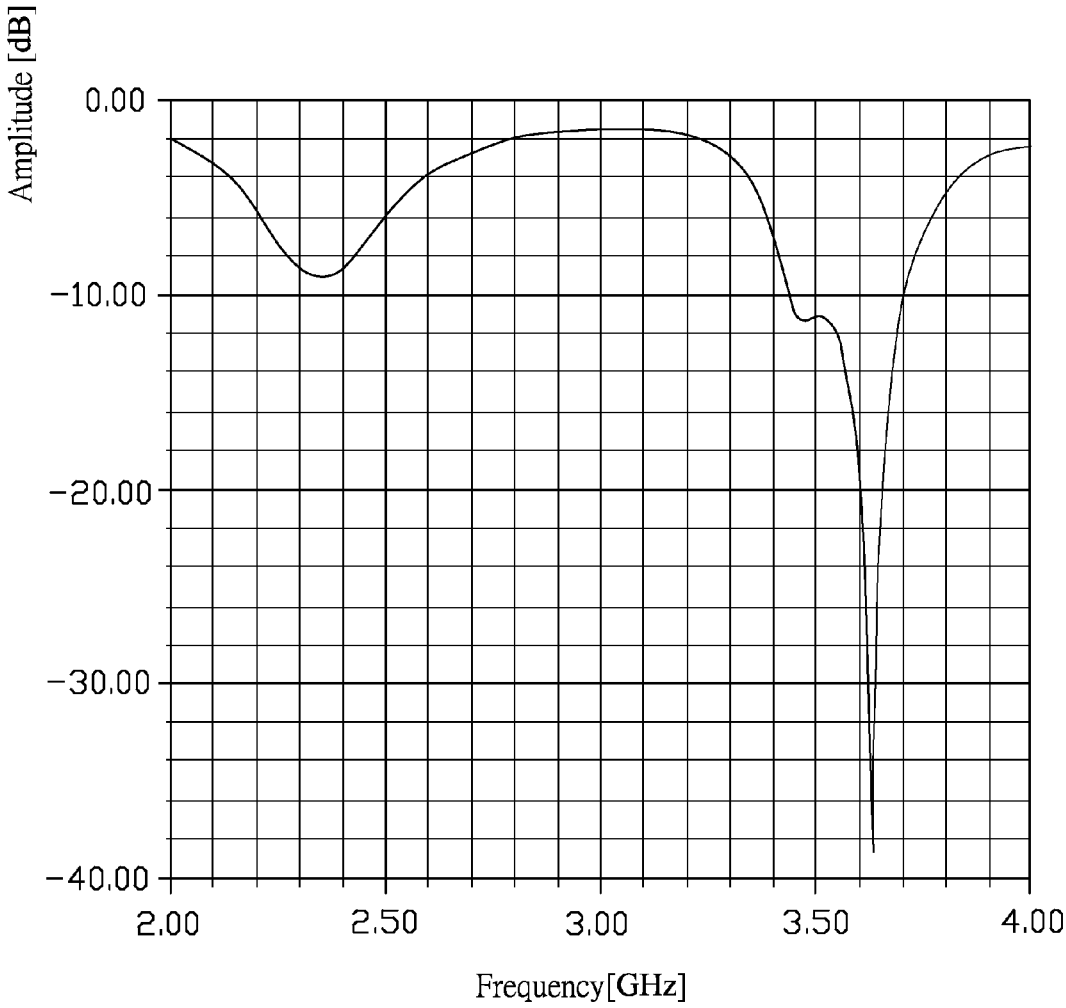
FIG. 6 is a graph showing one embodiment of a return loss of the slot antenna of FIG. 1.

FIG. 6 is a graph showing one embodiment of a return loss of the slot antenna 10 of FIG. 1. As shown, when the slot antenna 10 operates in frequency bands of approximately 3.5-3.7, the return loss is less than −10 dB.

The description of the present disclosure has been presented for purposes of illustration and description, and is not intended to be exhaustive or limited to the disclosure in the form disclosed. Many modifications and variations will be apparent to those of ordinary skill in the art. The embodiment was chosen and described in order to best explain the principles of the disclosure, the practical application, and to enable others of ordinary skill in the art to understand the disclosure for various embodiments with various modifications as are suited to the particular use contemplated.

What is claimed is:

1. A slot antenna positioned on a substrate, comprising:

a grounding portion positioned on the substrate;

a symmetrically octagonal-shaped radiating portion, defining along a continuous outside edge of the radiating portion, a first, a second, a third, and a fourth right-angle trapezoidal shaped slot; wherein the first slot is located in place of a first corner of the symmetrically octagonal-shaped radiating portion, the second slot is located in place of a second corner, which is immediately adjacent to the first corner, and the first and second slots are separated by only a first side of the octagonal-shaped radiating portion; wherein the third and fourth slots are located on corners of a second side located directly opposite the first side, wherein the four slots and symmetrically octagonal-shaped radiating portion is symmetric about at least two lines bisecting the symmetrically octagonal-shaped radiating portion, wherein the two lines are orthogonal; wherein the radiating portion is parallel along a Y-axis to the grounding portion so as to form a gap between the radiating portion and the grounding portion; and a feeding portion electronically connecting the radiating portion to the grounding portion, for feeding electromagnetic signals to the slot antenna.

2. The slot antenna as claimed in claim 1, wherein a joint of the feeding portion and the radiating portion is on another corner of the radiating portion without one of the four trapezoidal-shaped slots.

3. The slot antenna as claimed in claim 1, further comprising a connecting portion connecting the grounding portion to the feeding portion.

4. The slot antenna as claimed in claim 3, wherein the feeding portion and the connecting portion are cylindrically-shaped.

5. The slot antenna as claimed in claim 4, wherein the feeding portion is frictionally coupled to the connecting portion.

6. The slot antenna as claimed in claim 1, wherein the grounding portion and the radiating portion are made of iron.

7. The slot antenna as claimed in claim 1, wherein the gap is filled with air.

8. A slot antenna positioned on a substrate, comprising:

a grounding portion positioned on the substrate;

a radiating portion having a regular octagonal shape, defining along a continuous outside edge of the radiating portion, a first, a second, a third, and a fourth slot; wherein the first slot is located in place of a first corner of the regular octagonal shape radiating portion, the second slot is located in place of a second corner, which is immediately adjacent to the first corner, and the first and second slots are separated by only a first side of the regular octagonal shape radiating portion; wherein the third and fourth slots are located on corners of a second side located directly opposite the first side, wherein the four slots and regular octagonal shape radiating portion is symmetric about at least two lines bisecting the regular octagonal shape radiating portion, wherein the two lines are orthogonal; wherein the radiating portion is parallel along a Y-axis to the grounding portion so as to form a gap between the radiating portion and the grounding portion; and a feeding portion electrically connecting the radiating portion to the grounding portion for feeding electromagnetic signals to the slot antenna;

wherein a joint of the feeding portion and the radiating portion is on another corner of the regular octagonal shape without one of the four slots.

9. The slot antenna as claimed in claim 8, wherein the four slots comprises an elongated rectangular shape and are parallel with one another.

10. The slot antenna as claimed in claim 8, wherein the gap is filled with air.

* * * * *